United States Patent [19]

Nishikawa

[11] 4,324,486

[45] Apr. 13, 1982

[54] RECORDING DEVICE INCLUDING A HEATING MEANS

[75] Inventor: Masaji Nishikawa, Hachioji, Japan

[73] Assignee: Olympus Optical Company Limited, Tokyo, Japan

[21] Appl. No.: 44,968

[22] Filed: Jun. 4, 1979

[30] Foreign Application Priority Data

Jun. 8, 1978 [JP] Japan ..... 53/68253

[51] Int. Cl.[3] ..... G03G 15/00

[52] U.S. Cl. ..... 355/14 FU; 219/216; 307/141.4; 307/154; 355/3 FU

[58] Field of Search ..... 355/3 R, 3 FU, 14 R, 355/14 FU; 307/141.4, 154; 219/216

[56] References Cited

U.S. PATENT DOCUMENTS

| | | | |
|---|---|---|---|
| 3,881,085 | 4/1975 | Traister | 355/3 FU X |
| 3,976,374 | 8/1976 | Hickman | 355/14 R |
| 4,113,375 | 9/1978 | Murata et al. | 355/3 FU X |
| 4,145,599 | 3/1979 | Sakurai et al. | 219/216 |

*Primary Examiner*—Fred L. Braun

*Attorney, Agent, or Firm*—Haseltine and Lake

[57] ABSTRACT

The recording device has a heating unit operated and controlled to a predetermined operating temperature, the start of the recording device is governed so as not to operate the heating unit before its temperature reaches a predetermined operating value, the starting of the recording device is permitted prior to a certain time before the temperature of the heating unit reaches the predetermined operating value after the power supply is energized source for the recording device.

10 Claims, 12 Drawing Figures

RECORDING DEVICE INCLUDING A HEATING MEANS

BACKGROUND OF THE INVENTION

The present invention relates to a recording device such as an electrophotographic device or the like including a heating means.

Various heating means are often assembled in a recording device such as an electrophotographic device or the like. For example, in the recording device with the use of a wet-type developer, a heating means is used for the purpose of drying a developer adhered to a recording paper, in the recording device with the use of a dry-type developer, a heating means is used for the purpose of fixing a toner image formed on a recording paper, and in the recording device for transferring a toner image onto a recording paper by means of a heat-transfer roller, a heating means is used for the purpose of heating the transfer roller, respectively. These heating means cannot perform normal operation if they do not have a predetermined operating temperature, so that any normal electrophotographic image or the like cannot be obtained. Therefore, a warming-up time (preheating time) required from the switching-on of an electric power supply source of a heating means to the arrival of a predetermined operating temperature is unavailable for a copying process and becomes a waiting time, but the presence of the warming-up time is unavoidable in the heating means. In general, therefore, while an electric power supply source of a copying device is switched on, it is constructed that an electric power supply source of a heating means is always switched on so as to remove the waiting time. Even in this manner, however, a certain waiting time is always necessary when the power supply source of the copying device is switched on. In the conventional heating means, the warming-up time requires from several minutes to several tens minutes, so that it is very inconvenient to use the heating device, and then it has been tried to shorten this warming-up time in various ways. For example, in Japanese Utility Model Application Publication No. 21,740/74, Japanese Patent Application Publication No. 36,800/70, Japanese Patent Application Publication No. 13,586/76, Japanese Utility Model Laid-Open Publication No. 7,044/75 and the like, there are described that energy of the power supply source at the time of warming-up is made larger than that at the time of usual operation and the warming-up time is made short. In addition to the above, in some improved heating means with various measures, the warming-up time is shortened from several seconds to several tens seconds. However, there is no heating means which can obtain a warming-up time quick enough to be used for a copying process almost simultaneously with the switching-on of an electric power supply source within the range of limited electric power or practical durability. Such measure is, therefore, required that even if the warming-up time of a heating means is as it is, the copying process can be started as quick as possible. In a conventional copying device, an electric power supply source of the device, i.e., the electric power supply source of a heating means, is switched on and the temperature of the heating means reaches a predetermined operating value, and a permission for the start of copying is firstly displayed by detecting this temperature. In practice, however, it takes some time from the start of a copying process to the arrival of material to be heated (recording paper) and during this period, the heating means cannot be used for the copying process. In the conventional copying device, therefore, the waiting time during this period has been useless. There is surely no problem for such a waiting time in the above-mentioned conventional heating means which takes several minutes to several tens minutes for the warming-up time, but a copying device having an improved heating means in which the warming-up time is several seconds to several tens seconds can be shortened its waiting time by eliminating the above useless waiting time.

SUMMARY OF THE INVENTION

An object of the present invention is to eliminate the above described disadvantages of the conventional copying device.

Another object of the present invention is to provide a recording device is which the time required from the beginning of the start of the copying step to the arrival of the material to be heated to the heating device is used as a preheating time of the heating device.

According to the present invention a recording device including a heating means being operated and controlled to a predetermined operating temperature, means for inhibiting the operation start of the recording device so as not to carry out the operation of the heating means before the temperature of the heating means reaches a predetermined operating value, means for operating the heating means at the predetermined operating temperature obtained after elapsed a certain time from the operation start of the recording device, and means being operated in such a manner that the operation start of the recording device is permitted prior to the certain time before the temperature of the heating means reaches the predetermined operating value after the thrown on of the power supply source for the recording device. The operating means comprises a device for releasing the inhibit means for operation start of the recording device before the temperature of the heating means reaches the predetermined operating value.

The recording device further comprises a display device being operated before the heating means reaches the predetermined operating temperature and for displaying the permission of start of the recording device. The certain time is a time required from the beginning of the operation start of the recording device until a recording paper on which a toner image is transferred reaches to a heating and fixing device of the recording device.

The operating means comprises means for detecting the temperature of the heating means which is so constructed that it detects a first temperature to be detected of the heating means to generate a signal for permitting the operation start of the recording device and then detects a second temperature to be detected of the heating means to control the power supplying to the heating means. The temperature detecting means comprises an element for detecting the temperature of the heating means, and a comparator for comparing the output signal voltage of the temperature detecting element with a preset reference voltage which is selected to operate the comparator at the first temperature of the heating means, whereby the comparator generates the signal for permitting the operation start of the recording device and changes the value of the reference voltage to control the heating means at the second temperature.

The temperature detecting means comprises an element for detecting the temperature of the heating means or an ambient temperature, means for generating a first and a second preset reference voltages, and a first and a second comparators for comparing the output signal voltage of the temperature detecting element and the first and the second reference voltages, respectively, whereby the output signal of the first comparator permits the operation start of the recording device and the output signal of the second comparator controls the temperature of the heating means. The operating means comprises means for detecting the temperature of the heating means or an ambient temperature which is so constructed that it detects the temperature at the beginning of power supplying to the heating means to generate a signal for operating a delay timer and generates a signal for permitting the operation start of the recording device before the temperature of the heating means reaches the predetermined operating value. The delay timer comprises a circuit including a series combination of a thermistor and a capacitor to operate by detecting the increase of the voltage of the capacitor. The delay timer comprises means for deriving voltage signals from the output of the temperature detecting means, a pulsating circuit for converting the changes of the signal voltages into pulse shaped frequency changes and a preset counter for generating signals by counting the output pulses of the pulsating circuit. The operating means comprises a delay timer which is so constructed that it starts to operate simultaneously with the beginning of power supplying to the heating means and generates a signal for permitting the operation start of the recording device before the temperature of the heating means reaches the predetermined operating value.

DETAILED DESCRIPTION OF THE INVENTION

Figure 1:
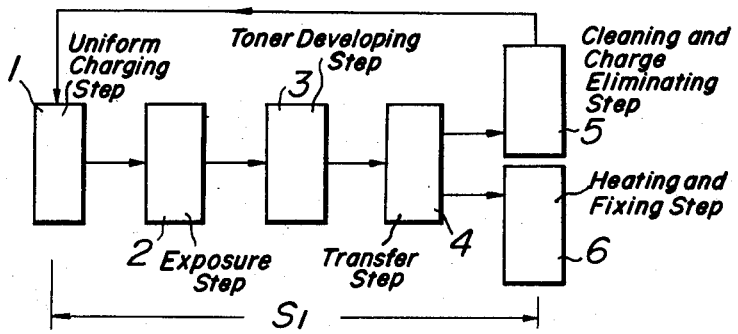
FIG. 1 is a block diagram showing operation process of one embodiment of a recording device having a heating device to which the present invention is applied.

FIG. 1 is a diagram showing the flow chart of a copying process of an electrophotographic device to which the present invention is applied. The copying process comprises a step 1 for uniformly charging a photosensitive drum (not shown), a step 2 for exposing an original image (not shown) to the photosensitive drum, a step 3 for toner-developing an electrostatic latent image formed by the step 2, and a step 4 for transferring the toner image formed by the step 3 onto a recording paper (not shown). The photosensitive drum having residual toner particles returns the uniform charging step 1 through a cleaning and charge-eliminating step 5. The recording paper on which the toner image is transferred proceeds to a heating and fixing step 6 for fixing the toner image and exhausted to the outside of the device. In addition, the electrophotographic device having the copying process described with reference to FIG. 1 will be explained hereinafter, but the present invention is not limited to the above but can be applied to any other recording devices which have some time from the start of any process to the actual operation of the heating means. For example, it may be applied to a recording device with the use of a heating means for the copying step 4 in FIG. 1.

In FIG. 1, let the start of the copying step, i.e., the time or term from the start of the uniform charging step 1 to the operation of the heating and fixing step 6, be $S_2$ second. The heating means for fixation has a warming-up time from the switching-on of the electric power supply source to a predetermined operating temperature, i.e., usable time, which is several seconds to several tens seconds even in the improved heating device as described above.

Figure 2:
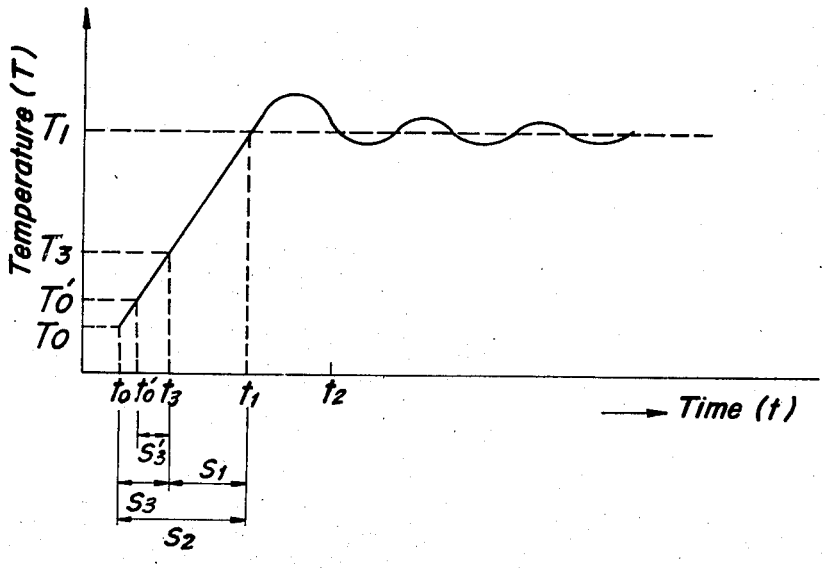
FIG. 2 is a diagram showing a state of rising temperature of the heating device.

FIG. 2 is a graph by taking the time from the switching-on of the electric power supply source as an abscissa and the temperature as an ordinate and shows such case that the temperature of the heating means at the time $t_0$ when the power supply source is switched on, i.e., the ambient temperature is $T_0$. In the conventional recording device, if the power supply source of the recording device is switched on, the temperature of the heating and fixing means is raised and a predetermined operating temperature, i.e., $T_1$, is obtained, the predetermined operating temperature is maintained almost constant by a temperature regulating means, while a temperature detector senses that the temperature becomes $T_1$ and a display means for displaying possible copying is actuated, and after the time $t_1$ the start of a copying step can be permitted. In this case, the uniform charging step 1 shown in FIG. 1 starts at this point $t_1$, and the recording paper actually reaches a heating and fixing means at the time $t_2$ after the term $s_1$ second has passed. The heating and fixing means, however, has already been under the usable condition at the time $t_1$, so that the time from $t_1$ to $t_2$ is also a "waiting time" for the heating and fixing means. If the uniform charging step 1 is started at the time $t_3$ earlier than the time $t_1$ by the term $s_1$ second, for instance, when the temperature of the heating and fixing means becomes a predetermined operating value at the time $t_1$ after the term $s_1$ second therefrom, the heating and fixing step 6 can be started and the "waiting time" for the heating and fixing means is eliminated and there is no waste. In this case, the start of the copying step is quickened by the term $s_1$ second, and the waiting time from the switching-on of the power supply source to the start of copying is shortened by the term $s_1$ second as compared with the conventional $t_1-t_0=s_2$ second and becomes a term $s_3$ shown in FIG. 2. As described above, in the fixing means having the improved short warming-up time as described above, the term $s_2$ is a value such as 15 seconds, and in this case, if the term $s_1$ is 6 seconds, the waiting time $s_3$ is 9 seconds. The reason why the term $s_1$ is 6 seconds, which is a value in common copying apparatus is that in a device for starting the uniform charging step 1 shown in FIG. 1 after rotating a drum once for the purpose of carefully cleaning the drum at the time of the start, the start of the copying step is the start of a first one rotation of the drum, and in this case, the time $s_1$ from the start of the copying step to the heating and fixing step becomes 12 seconds by adding one rotation (6 seconds) of the drum. In this case, the waiting time $s_3$ becomes 3 seconds by shortening 12 seconds.

The point as a problem for carrying out the present invention is that the points ($t_0$, $T_0$) for starting a temperature rise and the gradient of the rise shown in FIG. 2 are changed by fluctuations of the ambient temperature and a supply voltage. Therefore, the time ($s_2$) from the power supply source is switched-on at a moment ($t_0$) to the time ($t_1$) when the heating means becomes usable is not certain, and as a result, it is a problem which point is determined as a time ($t_3$) for starting the copying process.

Figure 3:
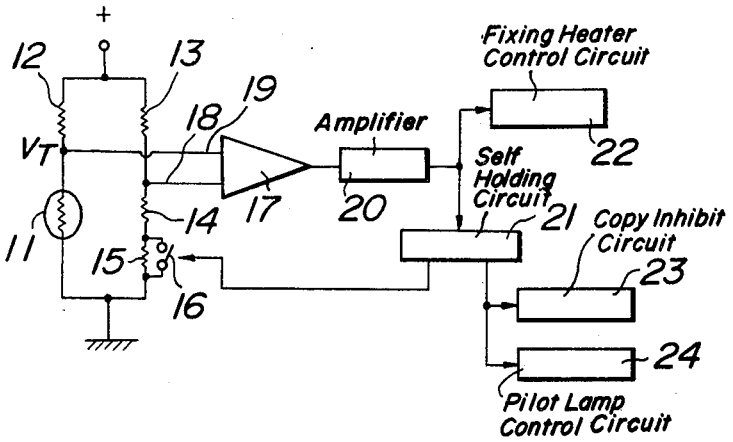
FIG. 3 is a diagram showing the construction of one embodiment according to the present invention having copying step so constructed that the beginning of copying may be permitted when the temperature of the heating device reaches a certain value set lower than the predetermined operating temperature of the heating device.

In an embodiment shown in FIG. 3, a copying step is started by detecting the time when the temperature of the fixing means becomes $T_3$ determined lower than the operating temperature $T_1$ by a predetermined temperature. The temperature $T_3$, as shown in FIG. 2, is selected in such a manner that the temperature changes from $T_3$ to $T_1$ after elapsed $s_1$ second. As described above, the gradient of the temperature rise is actually different due to a difference of the ambient temperature, so that it is impossible to determine $T_3$ one sided, but since heat quantity of the heating means is comparatively large and the recording device is not used under an extremely severe ambient temperature condition, the difference of the gradient is not a serious problem, and the temperature $T_3$ can be determined to a certain value in practice. It is naturally preferable to determine the temperature $T_3$ slightly higher than the temperature shown in FIG. 2 for allowance, or it is also preferable to change the temperature $T_3$ by taking the change of the temperature rise gradient into consideration. In FIG. 3, temperature detection of the fixing means is carried out by constructing a bridge containing a thermistor 11 on one side with resistors 12, 13, 14 and 15. One side of the bridge is composed of a series combination of the resistors 14 and 15, and one resistor 15 is short-circuited by a switch 16. The switch 16 is off state at first. The thermistor 11 is arranged at the position where the temperature T of the fixing means can be detected so as to change a resistance value of the thermistor 11 by the temperature T. When the switch 16 is opened, the resistance value of the thermistor 11 for balancing the bridge becomes lower than that when the switch is closed. The resistance of the thermistor is reduced as the temperature rises, so that it is possible to choose values of each resistor 12–15 in such a manner that when the switch 16 is opened, the temperature of the fixing means is $T_3$ and the bridge is balanced at the temperature $T_3$, and when the switch 16 is closed, the temperature of the fixing means is $T_1$ and the bridge is balanced at the temperature $T_1$. A comparator 17 for detecting equilibrium of the bridge is connected to junction points 18, 19, and the output of the comparator is supplied to a self-holding circuit 21, a fixing heater control circuit 22 through an amplifier 20. At the time when the electric power supply source is firstly switched-on, the temperature T of the fixing means is low, so that the equilibrium point of the bridge shifts the output of the comparator, to for example "0", and supply voltage is supplied to a heater in the fixing means through the heater control circuit 22 by this output "0". In this case, the self-holding circuit 21 is not set, a copy inhibit circuit 23 connected thereto is actuated for inhibiting the start of the copying process and this inhibition is displayed through a pilot lamp control circuit 24. The switch 16 is held open. When the temperature T of the fixing means rises to $T_3$, the equilibrium of the bridge is released, the potentials of the junction points 18, 19 become equal to each other and the equilibrium of the bridge is shifted to the opposite side. The output of the comparator 17 then becomes "1", the self-holding circuit 21 is set, the inhibition of the start of copying is released through the copy inhibit circuit 23 and the pilot lamp control circuit 24, and this situation is displayed. After this point, i.e., the point when the temperature of the fixing means becomes $T_3$, copying can be started. The output of the self-holding circuit 21 further closes the switch 16, so that the equilibrium of the bridge is again shifted to the initial direction and the output of the comparator 17 again becomes "0". Accordingly, the heater control circuit instantly cuts off the power supply source of the heater at the time when the temperature becomes $T_3$, but again puts the supply source of the heater so as to raise the temperature of the fixing means in succession. The switch 16 is then closed, so that the bridge is balanced at the time when the temperature of the fixing means becomes $T_1$, the output of the comparator 17 again becomes "1" and cuts off the supply source of the heater through the amplifier 20 and the heater control circuit 22. In addition, the self-holding circuit 21 does not change since it has already been maintained under set state. When the supply source of the heater is cut off and the temperature is lowered, the equilibrium of the bridge is again shifted to the direction for making the output of the comparator "0" and puts the supply source onto the heater through the heater control circuit 22. That is, the temperature of the fixing means is automatically controlled around the temperature $T_1$. In addition, the heater control circuit 22 is not only limited to the construction of merely switching on or off the power supply source of the heater, but the construction of switching the strength of the supply voltage from strong to weak or vice versa.

Figure 4:
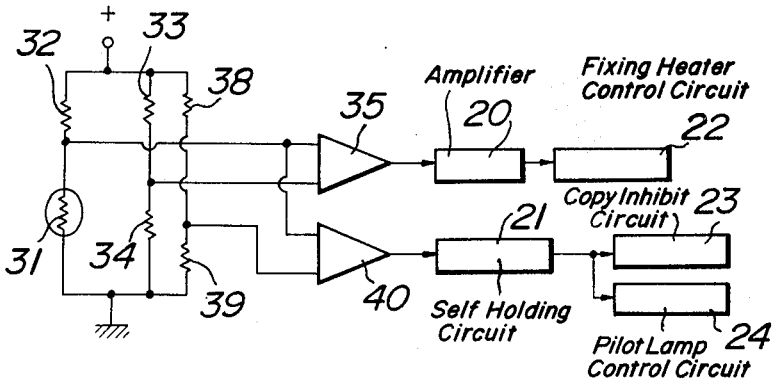
FIG. 4 is a diagram designating a modification of the embodiment shown in FIG. 3.

FIG. 4 shows an embodiment of the construction for releasing the start of copying by detecting the temperature $T_3$ in the same manner as the embodiment shown in FIG. 3. In this case, instead of switching the equilibrium temperature of the bridge from $T_1$ to $T_3$ by the switch 16, two bridges are provided and their equilibrium temperatures are made $T_1$ and $T_3$, respectively. That is, the equilibrium temperature of the bridge consisting of a thermistor 31 and resistors 32, 33 and 34 is $T_1$, this equilibrium is detected by a comparator 35 and the temperature of the fixing means is controlled to be around $T_1$ by the output of the comparator 35 through the amplifier 20 and the heater control circuit 22. On the other hand, the equilibrium temperature of the bridge consisting of the thermistor 31 and resistors 32, 38 and 39 is $T_3$, this equilibrium is detected by a comparator 40 and when the temperature of the fixing means becomes more than $T_3$, the copy inhibit circuit 23 and the pilot lamp control or lighting circuit 24 are controlled by the output of the comparator 40 through the self-holding circuit 21, and the inhibition of the start of copying is released. These actions are almost same as in FIG. 3, but in this case, when the temperature is more than $T_3$, the equilibrium of the latter bridge (thermistor 31 and resistors 32, 38, 39) is always shifted to the side for making the output of the comparator 40 "1", so that the self-holding circuit 21 is not necessary.

Figure 5:
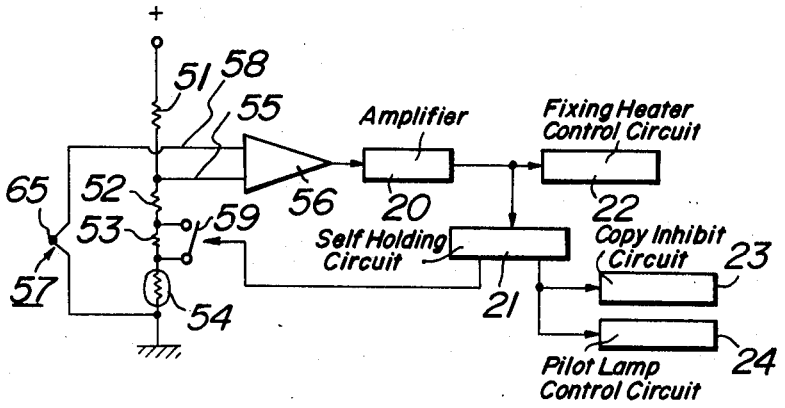
FIG. 5 is a diagram showing another embodiment using a thermocouple as a temperature detection element as in the idea of FIG. 3.
Figure 6:
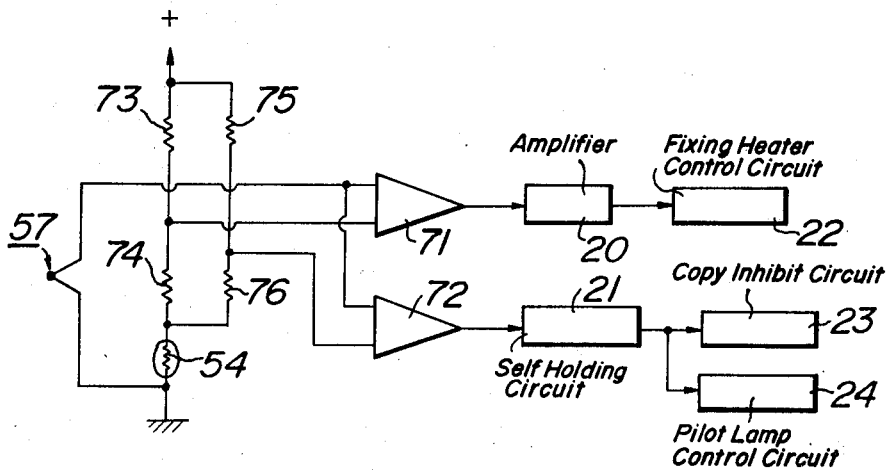
FIG. 6 is a diagram designating a modification of the embodiment shown in FIG. 5.

FIGS. 5 and 6 show the detection of the temperature of the fixing means with the use of a thermocouple. An embodiment shown in FIG. 5 is to divide the voltage of a reference voltage source by resistors 51, 52, 53 and a thermistor 54, to supply the voltage generated in a junction point 55 to one input terminal of a comparator 56, and to supply the voltage generated by a thermocouple 57 to the other input terminal 58 of the comparator 56. A switch 59 corresponds to the switch 16 shown in FIG. 3. When this switch 59 is closed, the voltage of the junction point 55, i.e., the voltage applied to one input terminal of the comparator 56, is made equal to the voltage generated by the thermocouple 57 when the temperature of the fixing means is $T_3$, i.e., the voltage applied to the other input terminal 58 of the comparator 56. When the switch 59 is opened, the voltage applied to the input terminal 55 is made equal to the voltage applied to the input terminal 58 when the temperature of the fixing means is $T_1$. According to such construction, when the switch 59 is closed, the output of the comparator 56 is changed at the time when the temperature of the fixing means is $T_3$ as a boundary, and when the switch 59 is opened, the output of the comparator 56 is changed at the time when the temperature of the fixing means is $T_1$ as a boundary, so that it is preferable to control the amplifier 20, the heater control circuit 22, the self-holding circuit 21, the copy inhibit circuit 23 and the pilot lamp control or lighting circuit 24 by the output of the comparator 56 in the same manner as in FIG. 3. In addition, an electromotive force of the thermocouple 57 is produced by a temperature difference between a temperature measuring contact 65 and a reference contact (not shown), the temperature of the reference contact is generally determined by the ambient temperature, so that when the ambient temperature, i.e., room temperature, is high, a low electromotive force is only generated even against the same temperature of the fixing means. The thermistor 54 is for compensation of the above low electromotive force and operates the comparator 56 when the temperature of the fixing means becomes $T_3$ and $T_1$. In addition, the reference contact of the thermocouple can be considered as a junction point for connecting a compensating conductor used as a thermocouple conductor to a common conductor, so that it is preferable to arrange the thermistor 54 in the vicinity of this junction point.

In FIG. 6, instead of switching the operating temperature of the comparator to $T_3$ and $T_1$ with the use of the switch 59 (FIG. 5), two comparators 71 and 72 are used for actuating respective temperatures $T_1$ and $T_3$, i.e., the output of the comparator 71 is changed by making the temperature $T_1$ the boundary, while the output of the comparator 72 is changed by making the temperature $T_3$ the boundary so as to determine values of the resistors 73, 74 and 75, 76. The other construction is same as in FIG. 5, so that like parts are designated by like numerals without any particular explanation. In this embodiment, self-holding circuit 21 can be omitted in the same manner as shown in the embodiment of FIG. 4.

Each embodiment described above is to permit the start of the copying process by detecting the temperature of the fixing means being reached a predetermined temperature $T_3$, but it is also possible to permit the start of the copying process by detecting the time $s_3 = t_3 - t_0$ (second) from the time $t_0$ (FIG. 2) of the switching-on of the power supply source to the time $t_3$ when the start of the copying becomes possible.

Figure 7:
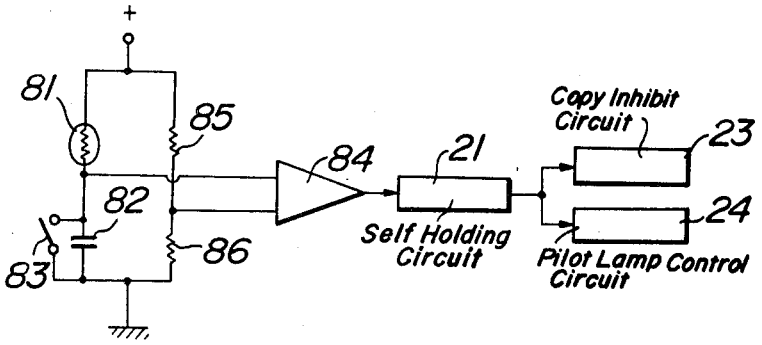
FIG. 7 is a diagram showing the construction of another embodiment so constructed that the beginning of copying may be permitted after a predetermined delay from the switching-on of the power supply source.

FIGS. 7 and 8 show these embodiments. These embodiments only show a method of controlling the start of the copying process and do not show the construction of controlling the temperature of the fixing means to a predetermined temperature $T_1$, but this construction is the same as shown in FIGS. 3–6. The embodiment shown in FIG. 7 is to set a delay time $s_3$ from switching-on the electric power supply source to the permission of the start of copying by an RC circuit composed of a thermistor 81 and a capacitor 82. Then the supply source of the fixing means is switched-on at the time of $t_0$, a switch 83 is opened at the same time and the charging to the capacitor 82 is started. A voltage of the capacitor 82 is supplied to one input terminal of a comparator 84 and a voltage set by dividing a reference voltage by resistors 85, 86 is supplied to the other input terminal of the comparator 84. The thermistor 81 is for changing the delay time $s_3$ by the value of the ambient temperature. For example, in FIG. 2, when the switching-on of the electric power supply source is carried out at an ambient temperature $T_0'$, if a difference of the temperature rising gradients of the heating means is ignored, it is considered that the supply source is switched-on at the time of $t_0'$, and in this case, the delay time up to the permission of the start of copying becomes $s_3'$, but if the thermistor 81 is arranged at the position where the ambient temperature can be detected, when the ambient temperature is high, the resistance value of the thermistor is lowered and the charging of the capacitor 82 is immediately carried out, so that the delay time becomes shortened and a proper delay time can be determined in accordance with the ambient temperature. In addition, the operations of the comparator 84 and the self-holding circuit 21 are same as in case of the above embodiments, so that an explanation thereof is omitted.

Figure 8A:
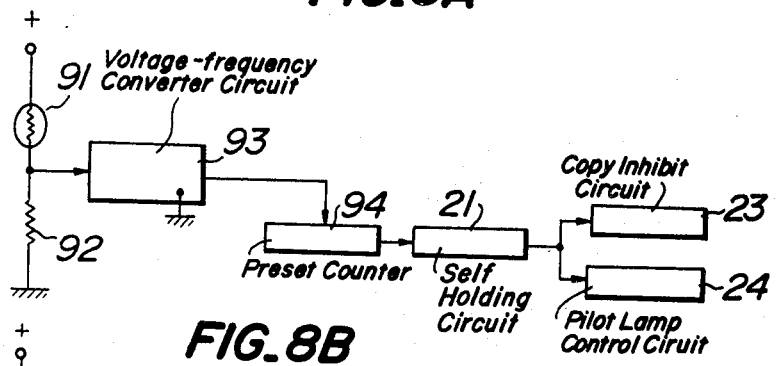
FIGS. 8A and 8B are diagrams showing embodiments in which a delay time is set by a counter circuit.
Figure 8B:
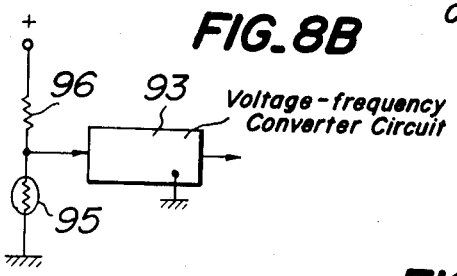

FIGS. 8A and 8B show embodiments for setting the delay time by means of a counter instead of the RC circuit. In FIG. 8A, a difference of the delay time due to the ambient temperature is set by a thermistor 91. That is, a voltage divided by a thermistor 91 and a resistor 92 is supplied to a V–F converter circuit, i.e., a voltage-frequency converter circuit 93, by which an output signal having a frequency in accordance with an input voltage is obtained, so that this output signal is further supplied to a preset counter 94, and when the output thereof reaches a certain number of counts, the self-holding circuit 21 or the like is actuated to permit the start of copying. An input voltage of the V–F converter circuit 93 becomes high when the ambient temperature is high, so that the frequency of the output thereof becomes high, and as a result, the time up to count a predetermined count value of the preset counter 94, i.e., the delay time, becomes shortened. In FIG. 8B, a posistor 95 is used instead of the thermistor 91. The ambient temperature is detected with the use of a combination of the resistor 96 and the posistor 95, but the other construction is same as in FIG. 8A and an explanation thereof is omitted.

As employed in the description, "POSISTOR" is a trade name of a positive characteristic thermistor developed by Murata Seisakusho and is a semiconductor ceramic resistor having resistivity of $10-10^6\Omega$.cm and manufactured by introducing very small amount of dopant in a barium titanate known as ferroelectrics.

Figure 9:
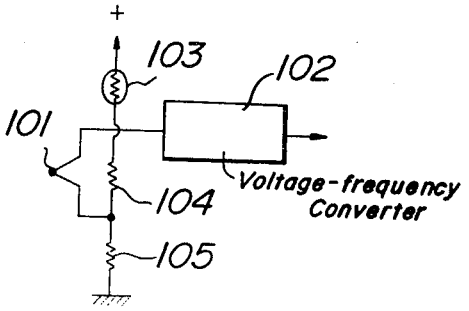
FIG. 9 is a diagram showing an embodiment with the use of a counter for detecting the temperature of the heating device.

FIG. 9 shows the digitalization of the construction for permitting the start of copying when the temperature of the fixing means becomes a predetermined value $T_3$ with the use of the thermocouple shown in FIG. 5. A voltage in accordance with the temperature of the fixing means detected by a thermocouple 101 is converted into a frequency by a V-F converter 102, the converted frequency is counted by a counter (not shown), thereby detecting when the temperature of the fixing means becomes $T_3$. In addition, a thermistor 103 and resistors 104, 105 are for compensating a change of an electromotive force of the thermocouple due to the ambient temperature, which has already been explained in FIG. 5.

Figure 10:
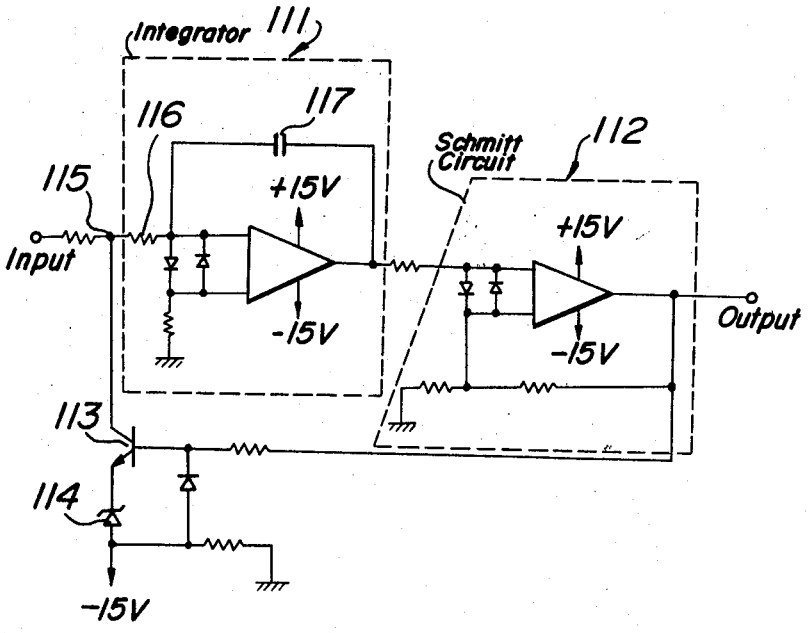
FIG. 10 is a diagram showing one embodiment of a voltage-frequency converter used in the embodiments shown in FIGS. 8 and 9.

FIG. 10 shows one embodiment of the V-F converter. An input voltage is integrated by an integrator 111 and its output reverses the state of a Schmitt circuit 112. As a result, a transistor 113 becomes conductive, and an emitter of the transistor 113 is clamped to a certain potential by a Zener diode 114, so that a negative voltage almost equal thereto is supplied to an input terminal 115 of the integrator 111. The integrator 111 integrates the voltage, the output thereof is changed from negative to positive by a time constant determined by a resistor 116 and a capacitor 117, and when this value crosses a dead zone width of the Schmitt circuit 112, the transistor 113 is again interrupted and the integrator 111 starts to integrate an input voltage thereof. This action is repeated and the output of the Schmitt circuit 112 obtains pulses of the frequency corresponding to the input voltage.

Figure 11:
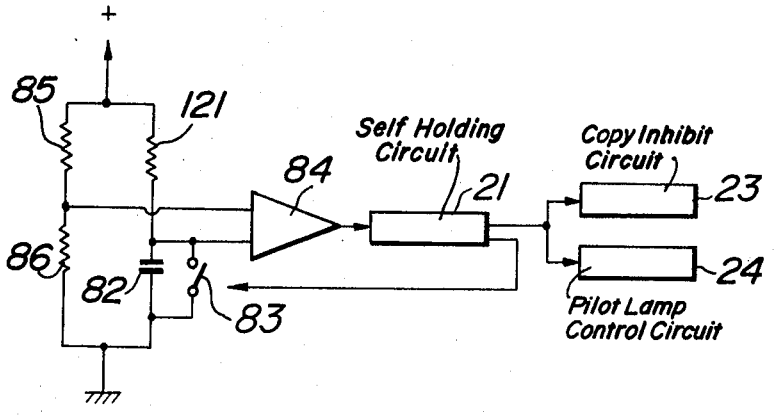
FIG. 11 is a diagram showing a modification of the embodiment shown in FIG. 7.

FIG. 11 shows a simplified embodiment of FIG. 7. That is, in this embodiment, the delay time $s_3$ from the time $t_0$ when the electric power supply source is switched on to the time $t_3$ when the copying process can be started is always made constant, and even if the ambient temperature, i.e., $T_0$, is changed, this delay time may not be changed. Therefore, a resistor 121 is used instead of the thermistor 81 shown in FIG. 7. The other construction is the same as in FIG. 7, so that like parts are designated by like numerals without any explanation. In this embodiment, however, after the inhibition of the start of copying is released by the output of the self-holding circuit 21, the switch 83 is closed. As in this embodiment, even if the delay time $s_3$ is not changed by the ambient temperature, the reason why there is no problem in practice is as follows. That is, the case of setting the operating temperature of the fixing means 300° C. is considered. When the ambient temperature is 10° C., it is supposed that 15 seconds are taken for rising the temperature to 300° C. In this case, if the ambient temperature is 35° C., supposing there is no heat which goes in and out between a heating system of the fixing means and the outside for the sake of simplification, it takes 14 seconds for rising the temperature to 300° C. It is a matter of course that the heat goes in and out of the outside and it does not meet as calculated in the above, but in either case, the operating temperature of the fixing means is sufficiently high as compared with a room temperature, so that even if the room temperature is change to some extent, a change is hardly caused in the heating time, and as a result, even if the delay time $s_3$ is made constant, there is no problem in practice.

In addition, the present invention is not limited to the above embodiments but can use a thermistor having positive characteristic, i.e. Posistor, instead of the thermistor as a temperature detecting element. Further, a timer used for delaying time is not limited to the above described CR timer or the like but a motor timer, a timer for counting a frequency of an electric power supply source, or the like. The applicable range of the present invention is not limited to a heating and fixing device of the electrophotographic device but applied to a liquid developer drying device of recording devices of each kind such as a printer or the like, a toner image heat-transfer device, a developing device of a heat developing photosensitive paper (for example, dry silver paper made by 3M Co.) or the like.

According to the present invention, the time from the start of the copying process to the actual use of the heating means can be used as a preheating time of the heating means, so that the time for starting the copying process can be quickened and any useless waiting time can be eliminated or shortened.

What is claimed is:

1. In a recording device including a heating means being operated and controlled to a predetermined operating temperature, means for inhibiting starting of recording by the recording device until the heating means reaches a predetermined operating temperature after a power supply source of the recording device has been switched on, and an operating means for performing the start of recording, said operating means being effective after the heating means has reached the predetermined operating temperature, wherein:

the improvement comprises: means for releasing said inhibiting means so as to allow the start of recording upon actuation of said operating means within a certain time period before the heating means has reached the predetermined operating temperature.

2. A recording device as claimed in claim 1, further comprising a display device for displaying the permission of start of the recording step, said display device being operated before the temperature of the heating means reaches the predetermined operating temperature.

3. A recording device as claimed in claim 1, wherein the certain time is a time required from the start of the recording step until a recording paper on which a toner image is transferred reaches to a heating and fixing device of the recording device.

4. A recording device as claimed in claim 1, wherein the operating means comprises means for detecting the temperature of the heating means, said detecting means being so constructed that it detects a first sensing temperature of the heating means to generate a signal for permitting the start of the recording step and then detects a second sensing temperature of the heating means to control the power supplying to the heating means.

5. A recording device as claimed in claim 4, wherein the temperature detecting means comprises an element for detecting the temperature of the heating means, and a comparator for comparing the output signal voltage of the temperature detecting element with a preset reference voltage which is selected to operate the comparator at the first temperature of the heating means, whereby the comparator generates the signal for permitting the operation start of the recording step and changes the value of the reference voltage to control the heating means at the second temperature.

6. A recording device as claimed in claim 4, wherein the temperature detecting means comprises an element for detecting the temperature of the heating means or an ambient temperature, means for generating a first and a second preset reference voltages, and a first and a second comparators for comparing the output signal voltage of the temperature detecting element with the first and the second reference voltages, respectively, whereby the output signal of the first comparator permits the start of the recording step and the output signal of the second comparator controls the temperature of the heating means.

7. A recording device as claimed in claim 1, wherein temperature at ans comprises means for detecting the the beginning of power supplying to the heating means to ure, generate a signal for operating a delay timer and generates a signal for permitting the start of the recording step before the temperature of the heating means reaches the predetermined operating value.

8. A recording device as claimed in claim 7, wherein the delay timer comprises a circuit including a series combination of a thermistor and a capacitor to operate by detecting the increase of the voltage of the capacitor.

9. A recording device as claimed in claim 7, wherein the delay timer comprises means for deriving voltage preset signals from the output of the temperature detecting means, a pulsating circuit for converting the changes of the signal voltages into pulse shaped frequency changes and a preset counter for generating signals by counting the output pulses of the pulsating circuit.

10. A recording device as claimed in claim 1, wherein the operating means comprises a delay timer which is so constructed that it starts to operate simultaneously with the beginning of power supplying to the heating means and generates a signal for permitting the start of the recording step before the temperature of the heating means reaches the predetermined operating temperature.

* * * * *